United States Patent [19]

Smith

[11] 4,375,287

[45] Mar. 1, 1983

[54] AUDIO RESPONSIVE DIGITAL TOY

[76] Inventor: Henry C. Smith, 7629 Corozal, El Paso, Tex. 79915

[21] Appl. No.: 246,308

[22] Filed: Mar. 23, 1981

[51] Int. Cl.[3] ..... A63F 9/00

[52] U.S. Cl. ..... 273/138 A; 273/1 E

[58] Field of Search ..... 273/237, 138 A, 139, 273/1 E, 1 GC; 46/232, 256

[56] References Cited

U.S. PATENT DOCUMENTS 3,799,553 3/1974 Hurley ..... 273/138 A 4,305,131 12/1981 Best ..... 273/DIG. 28

OTHER PUBLICATIONS

Leslie Solomon, "Cry Alert", 10/81, p. 81, Popular Electronics.

*Primary Examiner*—Vance Y. Hum

*Assistant Examiner*—Leo P. Picard

*Attorney, Agent, or Firm*—Richard L. Miller

[57] ABSTRACT

A digital toy which produces a random response to an audible inquiry. During the time of the audible inquiry, a switch is depressed. During that switch depression time a random response of the yes or no type is determined and at the same time an enabling signal is generated so long as an audible inquiry has been detected. Upon release of the switch the enabling signal causes binary coded decimal lights to flash and simultaneously tones to be sounded for a time period followed by a buzzer sound after which the predetermined response is displayed.

6 Claims, 2 Drawing Figures

AUDIO RESPONSIVE DIGITAL TOY

BACKGROUND OF THE INVENTION

This invention relates to an electronic toy, and more particularly to a digital device which provides a random response to an audible inquiry.

Electronic toys are presently available which simulate various types of sports games and other types of activities and which are energized by batteries so as to be portable. Many of these utilize various types of displays for displaying the result of a particular score. Others utilize sounds to simulate achieving various events. However, all of these are designed in accordance with specific rules governing the game, whether it is a sporting event or other type of game being simulated.

While these electronic games provide enjoyment, they require a certain amount of skill and experience and the ability to manipulate such games are generally dependent upon the continued usage of the electronic toy. However, many individuals get frustrated with such electronic toys if they cannot easily master the device without an undue amount of experience.

Thus, while the thrill of the flashing lights, audible sounds, and other sensory outputs generally accompanying electronic toys are an inducement for utilizing such toys, the requirement for experience and skill detracts from their use. It would accordingly be desirable to provide an electronic toy which provides the thrill of the varied sensory outputs while not requiring experience to master the utilization of the toy.

At the same time, thus far electronic toys have all be rigidly prefixed in accordance with the specified rules of the game which it simulates. Electronic toys have generally not been utilized to provide a simple random output effect while at the same time providing the sensory output accompanying such electronic toys.

Accordingly, while electronic toys of various types are available, it would appear that there still exists a need for a suitable electronic toy which can provide the sensory output to thrill the operator, provide a random output which can be useful in conjunction with specified types of games, and avoid the necessity for requiring a lengthy time to master utilization of the device.

SUMMARY OF THE INVENTION

Accordingly, it is an object of the present invention to provide an electronic toy which avoids the aforementioned problems of prior art devices.

Still another object of the present invention is to provide an electronic toy which provides a random response to an audible inquiry.

Still another object of the present invention is to provide an electronic toy which can receive an audible inquiry and provides a binary response, of the "yes" or "no" type, randomly in response to the question.

A further object of the present invention is to provide a digital toy which responds only upon receiving an audible inquiry and upon receipt of such inquiry generates varied sensory effects until it ultimately displays a random binary response to the inquiry.

Another object of the present invention is to provide a digital toy which can receive an audible inquiry, and in response thereto, displays flashing binary coded decimal lights and at the same time produces musical notes, after which a buzzer sounds and a random "yes" or "no" answer to the inquiry is displayed.

The present toy is utilized to provide fun and enjoyment during the course of playing a question and answer game. The purpose of the toy is essentially to provide a random answer of the "yes" or "no" type in response to an audible inquiry. The user can therefore ask any question and the digital toy will provide a yes or no answer. The randomness of the answer will produce fun in responding to the question.

At the same time, prior to giving the response the toy will flash binary numbers, emit audible tone sounds, sound a buzzer and then emit the answer. Accordingly, the device can provide fun and enjoyment in utilizing it and at the same time provide additional fun in coming up with an arbitrary random response to the inquiry.

Briefly, there is provided a digital toy for giving a random response to an audible inquiry. The toy includes a switch having a first and second position. A response determining circuit is activated during placement of the switch in its first position and determines a random response. An audio detecting circuit is activated during placement of the switch in its first position and provides an enabling signal responsive to the detection of an audible inquiry. A display device is activated by the enabling signal during the placement of the switch in its second position for displaying the random response determined.

In an embodiment of the invention, during the placement of the switch in its second position, prior to the display of the random response, there will first be emitted sensory outputs such as optical display of binary coded decimal numbers, tone signals audibly emitted as well as a buzzer shortly before the display of the random response.

The foregoing objects, advantages and features of the invention will, in part, be pointed out with particularity and will, in part, become obvious from the following description of the invention taken in conjunction with the drawings which form an integral part thereof.

BRIEF DESCRIPTION OF THE DRAWINGS

In the drawings.

In the various figures of the drawing, like reference characters designate like parts.

DESCRIPTION OF THE PREFERRED EMBODIMENT

Figure 1:
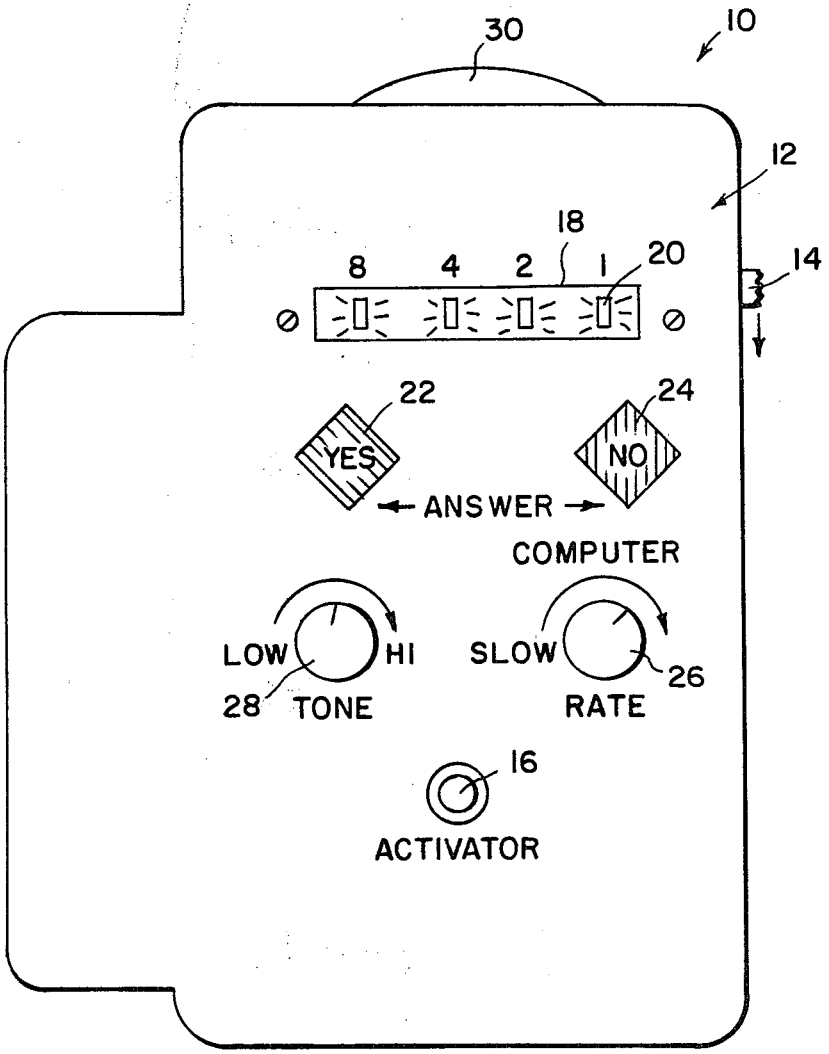
FIG. 1 is a front view of the digital electronic toy in accordance with the present invention.

Referring now to FIG. 1, the digital electronic toy of the present invention is shown generally at 10 and comprises a housing 12 having a main ON/OFF switch 14 positioned on one side thereof which interconnects a battery contained within the housing to the circuitry also contained within the housing. With the switch 14 in the ON position, a question can be verbally asked. During the time that the question is being asked, the activator switch 16 should be depressed. During that time, the internal circuitry contained within the housing will produce a random binary response, as will hereinafter be explained.

After completing the question, the push button activator switch 16 is released. The internal circuitry contained within the housing will then cause the binary coded decimal display unit 18 to display an increasing sequence of binary coded decimals from zero through 9. Specifically, there are provided four LED's 20 in the unit 18 each of which represents a binary coded decimal number 1, 2, 4, 8. In accordance with well known binary coded decimal numbers, the display unit will display such increasing sequence of numbers.

At the same time, musical notes will be sounded from the device in synchronism with the emission of light from the LED's.

After an interval of time during which both the BCD numbers and the notes are emitted, both of these will stop and a buzzer sound will be heard. After that, the binary response previously calculated will be displayed by means of either the yes display 22 being illuminated, or the no display 24 being illuminated.

Additional controls are provided including the knob 26 which controls the interval of time following which the activator 16 is released until the answer will be shown by the display 22 or 24. Typically, the control can be from approximately 15 seconds, indicating a slow response, until about 3 seconds, indicating a fast response. A tone control 28 is also provided which determines the pitch of the musical notes which will be emitted during the time interval from release of the activator 16 until the answer is displayed on the yes or no indicators 22, 24.

The combination speaker and microphone 30 is provided on the housing and is utilized for various purposes. During the interval that the activator push button switch 16 is depressed, the microphone portion will be utilized to be sure that an inquiry is received.

The circuit is so provided that if no audible inquiry is detected, no response will be given. The speaker portion of the unit 30 is utilized to emit the tone sounds during the interval after release of the activator push button switch 16. It also is utilized to emit the buzzer sound after termination of the tone sounds.

Accordingly, the device operates as follows: The user states any question. During the time that he states the question he depresses the activator 16. When he finishes the question he releases the activator. The LED's 20 will flash and the speaker 30 will emit a series of notes for an interval which can be controlled by the knob 26. The tone knob 28 controls the pitch of the sound. After this interval a buzzer will sound following which the answer will appear at random out of the displays 22 or 24. If no question was asked the device will not operate and no display nor sounds nor response will be given.

It should be appreciated that there is no relation between the question asked and the specific response given. Accordingly, the device does not give an accurate answer representing the truth or falsity of the question asked. On the other hand, it is a fun device which provides a random answer to the question. For example, if the user asks the question: "Does Mary love me?", the device will provide a random answer of either yes or no. However, the fun of the game is that the answer is in fact random. Furthermore, because of the flashing LED's, the sounds and the buzzer, it provides a thrill and feeling of an electronic toy during the course of providing this response.

Figure 2:
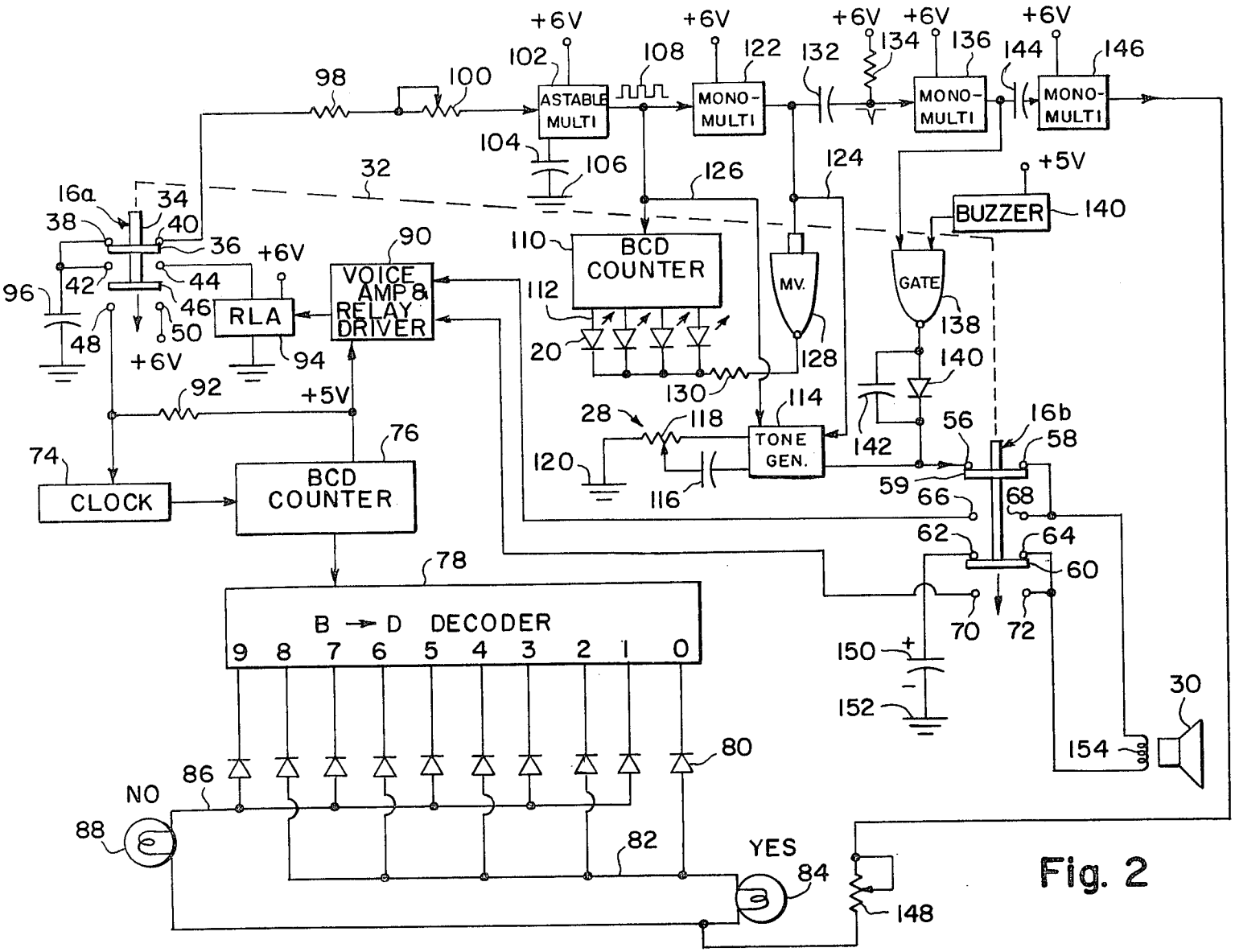
FIG. 2 is a block diagram showing the circuit of the digital electronic toy in accordance with the present invention.

The specific circuitry which is utilized to produce the device is now shown with respect to FIG. 2. After the ON/OFF switch is turned on the battery is ready for operating the circuitry. When the question is asked, the activator switch 16 should be depressed. Switch 16 is a ganged switch as shown by the dotted line 32 and includes the portions 16A and 16B. 16A is shown as including a plunger 34 having a first contact bar 36 which normally interconnects the contacts 38 and 40. When depressed, the bar 36 will instead interconnect the contacts 42 and 44. Additionally, the bar 46 also contained on the plunger 34 will not interconnect contact 48 to contact 50.

The second part of the switch 16B also includes a plunger 52 having a first bar 54 which normally interconnects the contacts 56 and 58 and a second bar 60 which normally interconnects the contacts 62 and 64. When the switch 16 is depressed, the bar 54 will now interconnect the contacts 66 and 68 while the bar 60 will now interconnect the contacts 70 and 72.

With the switch 16A depressed, it moves downward. It will therefore now interconnect terminals 50 and 48 so as to energize the clock 74 which will continuously count during the entire interval that the switch 16A is depressed. The output of the clock 74 is counted by the binary coded decimal counter shown at 76. This output is then sent to a binary to decimal decoder 78 which converts the binary count into a decimal count and produces outputs along the lines identified as the numbers zero through 9. Connected at the output of each of these lines is contained a diode 80 with its low terminal connected to the decoder. The high terminal of the diodes are alternately connected. Thus, the diodes associated with the lines zero, 2, 4, 6 and 8 are interconnected through the common bus line 82 to a first illumination device, such as the bulb 84 which represents a yes answer. The other diodes in the lines 1, 3, 5, 7 and 9 are interconnected to the bus line 86 which connects to the illumination bulb 88 representing a no answer.

Accordingly, when the activator switch 16 is depressed, and throughout the entire interval of such depression, the clock starts and continuously counts. The count will be decoded by a continuously repetitive cycle of counts from zero through 9. When the switch 16 is released, a logic zero, or a low signal is stored at one of the outputs 0–9 from the decoder 78.

The particular output will, of course, be dependent upon the particular number at the output of the decoder which, in turn, is dependent upon the length of time that the switch 16 is depressed. However, this number will be a random number since there are a series of variables which are unidentifiable to the user.

The length of time of the depression of the switch should typically correspond to the length of the question. Accordingly, this itself presents the first variable. In addition, there is the reaction time of the operator which also provides a variable. Furthermore, the reaction time of the mechanical switch 16 also provides some variation. Furthermore, the clock is somewhat temperature sensitive and the clock pulse repetition rate is to some extent a function of this temperature. For example, the particular clock which is utilized showed a variation of 100 KHz to 200 KHz per 10° C. above or below ambient temperature.

Utilizing the specific circuitry, it was found that the time interval between a yes and a no answer was 0.377 microseconds. Accordingly, with such small interval of time between the yes and no selection, a randomness was clearly provided. Such randomness is, as heretofore explained, dependent upon the time of depression, the response time of the operator, the response time of the mechanical switch, and the temperature.

During the course of various tries, although it would be expected that a response of yes and no occurred at 50% each, it was found that during a first trial of 100 tries there were 51 yes responses and 49 no responses. During a second 100 tries there were 47 yes responses and 53 no responses. A third set of 100 produced 52 yes responses and 48 no responses, a fourth set of 100 produced 53 yes responses and 47 no responses, and a fifth set produces 49 yes responses and 51 no responses. Accordingly, it is noted that some randomness does occur and yet there is provided somewhat of a 50-50 chance of coming up with a yes or no answer.

When the switch 16 is depressed, the portion of the switch 16B moves downward and interconnects the combination microphone and speaker 30 in series with the voice amplifier and relay driver 90. This device is energized from the battery source when the switch 16A is depressed. The 6 volts is sent through the bar 46 interconnecting terminals 48 and 50 which also pass the voltage through the resistor 92 so as to provide approximately 5 volts which is needed to drive the voice amplifier and relay driver 90. When any question is asked within a given area of detection by the microphone 30, it will cause the driver 90 to operate the relay 94 which will be energized through the 6 volt battery source. When the relay 94 is energized, it permits the 6 volts to pass through the bar 36 which now interconnects the terminals 42 and 44 so as to charge the capacitor 96 with the six volts from the battery.

In the particular embodiment utilized, the driver 90 was activated whenever sounds of between 75 and 800 Hz was received. The area of receiving was approximately 20 inches of the toy. The driver 90 provided amplification of approximately 250 times.

Accordingly, when the question is being asked, the switch 16 is depressed which causes two things to occur. Firstly, it causes the response determining circuit including the clock to determine a random response. Secondly, it determines if an audible question was asked and if such audible sounds are detected, it stores an enabling signal onto the capacitor 96 for subsequent use. Should no audible question be asked, no enabling signal will be stored on capacitor 96 and accordingly, no further action will take place, as will hereinafter be explained.

When the switch 16 is released, it automatically returns to its initial position. In doing so, it now causes the charge stored on the capacitor 96 to pass through the bar 36 interconnecting the contacts 38 and 40. The charge passes through the fixed resistor 98 and the variable resistor 100 to the astable multivibrator 102. The astable multivibrator 102 is connected to the 6 volt battery supply and is also connected through the capacitor 104 to ground 106.

The variable resistor 100 is connected to the knob 26 as shown in FIG. 1 and represents the rate control switch. This rate control has a dual function. Firstly, in conjunction with the capacitor 96 it determines the running time of the astable multivibrator 102. In addition, in conjunction with the resistor 98 and the capacitor 96, it also determines the starting frequency of the astable multivibrator 102.

As the capacitor 96 is discharging, it causes the astable multivibrator 102 to produce a continuous series of pulse as shown at 108. These pulses are sent to a binary coded decimal counter indicated at 110. This counter 110 counts the number of pulses and produces a binary coded output on its output lines 112. A light emitting diode 20 as was shown in FIG. 1, is respectively connected in each of the outputs 112 and are continuously displayed.

The output from the astable multivibrator 102 is also sent to a tone generator 114. The specific pitch of the tone generator is controlled by means of the capacitor 116 and the variable resistor 118, which together form the tone control circuit 28 shown in FIG. 1. The other end of the resistor 118 is connected to ground at 120.

The output from the astable multivibrator 102 is also sent to a retriggerable monostable multivibrator 122 which is also energized from the 6 volt battery. The monostable multivibrator 122 remains with a high output as long as it receives pulses from the astable multivibrator 102. When the astable multivibrator 102 stops pulsing, the output from the monostable multivibrator 102 goes to a low.

Accordingly, the monostable multivibrator 122 provides a hold signal for both the tone generator and the light emitting diodes. Specifically, the high signal output from the monostable multivibrator is sent on line 124 to continuously energize the tone generator so long as the astable multivibrator provides signals. The signals from the astable multivibrator provides the frequency modulating signals on line 126 to the tone generator 114. The output from the monostable multivibrator 122 passes through the inverter 128 so as to provide a low signal through the resistor 130 to the light emitting diodes.

The charge from the capacitor 96 therefore causes the astable multivibrator to produce its output which in turn causes the LED's 20 to continuously display and causes the tone generator 114 to continuously sound. As the charge on the capacitor 96 reduces, the output from the astable multivibrator 102 slows down and coasts to a stop. When it reaches a lower threshold value, as for example 3 volts, the monostable multivibrator 122 will turn to its low state therefore causing the LED's 20 to stop displaying and causing the tone generator 114 to stop sounding.

The change of state from a high to a low at the output of the monostable multivibrator is sent through the capacitor 132 and the resistor 134 as a trigger pulse to the monostable multivibrator 136 which causes it to switch to a high output. This high output opens the gate 138 thereby allowing the free running buzzer 140 to pass through gate 138, through the parallel combination of the diode 140 and the capacitor 142 and then onto the speaker.

Since only a single pulse signal is sent from the monostable multivibrator 122 to the monostable multivibrator 136, the multivibrator 136 will return back to its low state thereby shutting off the buzzer. The change back to its low state, is sent through the capacitor 144 to the further monostable multivibrator 146. When this monostable multivibrator 146 goes to its high state, the signal passes through the variable resistor 148 to complete the circuit at the two bulbs 88 and 84. The specific bulb which was previously energized with the random output is now forward biased so that the information stored earlier at the decoder outputs is now displayed as either a yes or no answer. These displays 88, 84 correspond to the displays 22, 24 previously shown on the housing in FIG. 1. The display will continue for a preset amount of time, depending upon the length of the pulse of monostable multivibrator 146. Typically, this can be set to about 5 seconds. After that the monostable 146 returns to its low state thereby turning off the displayed bulb.

It should be noted that when the switch 16B is returned to its position after the activator 16 is released, the speaker unit 30 is interconnected to provide outputs from the tone generator or the buzzer, as the case may be. Specifically, one end of the speaker coil 154 is connected through the bar 60 to the capacitor 150 and then to ground 152. The other end of the speaker coil 154 is connected through the bar 54 to either the output of the tone generator, during the time the astable multivibrator 102 is operating. At the end of the operation of the astable multivibrator 102, it is then connected to the buzzer through the gate 138.

The variable resistor 148 can be provided as a brightness control and can be included as an additional switch on the housing unit, if so desired. It should be appreciated, that the output of the tone generator 114 is pulse position modulated tone bursts which are in synchronization with the flashing of the LED's 20.

It is therefore appreciated that during the time that the switch 16 is depressed, the random response is determined and the enabling signal responsive to the presence of an audible question is stored. When the switch 16 is released, the enabling signal is then converted into a time delay signal and that time delay signal is utilized to cause the flashing of the LED's displaying a binary coded number and to sound the particular tone signals. At the conclusion of the time delay signal, a buzzer will sound and then the previously determined random answer will be displayed.

Accordingly, the digital toy provides fun in determining a random response to a question, and at the same time provides the thrill of the usual electronic toys having flashing lights and emitting sounds.

At the same time, the digital toy provides an educational purpose. It teaches individuals familiary with the binary number system, binary coded decimal system, and various aspects of the events occurring in these categories. It also provides information concerning the function of digital and linear devices such as timers, counters, decoders and sound activated circuits. The toy also presents a good demonstration of how information can be electronically stored during one interval of time and subsequently called out and displayed at a subsequent predetermined time.

There has been described heretofore the best embodiments of the invention presently contemplated. However, it is to be understood that variations and modifications may be made thereto without departing from the teachings of the invention.

I claim:

1. A digital toy providing a random response to an audible inquiry, comprising:

switch means having first and second positions;

response determining means activated during placement of said switch means in said first position for determining a random response;

audio detecting means activated during placement of said switch means in said first position for providing an enabling signal responsive to the detection of an audible inquiry;

display means activated by said enabling signal during the placement of said switch means in said second position for displaying the response determined wherein said display means comprises delay means for converting said enabling signal into a timed signal, and circuit means for producing a sensory display output during said timed signal and upon termination thereof displaying said random response; and said circuit means comprises pulse means for producing output pulses during the duration of said timed signal, counter means for counting the output pulses, and optical display means for optically displaying the counter of said counter means.

2. A digital toy as in claim 1, wherein said circuit means further comprises tone generator means for providing output sounds, said output pulses frequency modulating said tone generator means, whereby said tone generator means produces its output sounds responsive to said output pulses, and speaker means for audibly reproducing said output sounds.

3. A digital toy as in claim 2, and further comprising control means coupled to said tone generator means for varying the pitch of the output sound.

4. A digital toy as in claim 2, and further comprising trigger means responsive to the termination of said timed signal for terminating said audible sounds and said optical display, and for causing said random response to be displayed for a predetermined interval.

5. A digital toy as in claim 4, and further comprising audible sounding means for producing a distinct audible sound through said speaker means responsive to said termination by said trigger means.

6. A digital toy as in claim 1, wherein said response determining means comprises clock means activated throughout the placement of said switch means in said first position, counter means for counting the output of said clock means, decoding means for decoding the output of said counter means into continuous repetitive numeric count series, and a pair of indicator means respectively responsive to alternate ones of the count of said count series, whereby a random binary output is produced.

* * * * *